US011866858B2

(12) United States Patent
Nagae et al.

(10) Patent No.: US 11,866,858 B2
(45) Date of Patent: Jan. 9, 2024

(54) TEXTILE AND GARMENT

(71) Applicant: Teijin Frontier Co., Ltd., Osaka (JP)

(72) Inventors: Takuya Nagae, Osaka (JP); Akio Ukuma, Osaka (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 185 days.

(21) Appl. No.: 17/601,737

(22) PCT Filed: Apr. 1, 2020

(86) PCT No.: PCT/JP2020/014977
§ 371 (c)(1),
(2) Date: Oct. 6, 2021

(87) PCT Pub. No.: WO2020/213395
PCT Pub. Date: Oct. 22, 2020

(65) Prior Publication Data

US 2022/0170187 A1 Jun. 2, 2022

(30) Foreign Application Priority Data

Apr. 15, 2019 (JP) ..... 2019-077140

(51) Int. Cl.

| | |
|---|---|
| ***D03D 15/283*** | (2021.01) |
| ***A41D 31/04*** | (2019.01) |
| ***D03D 15/00*** | (2021.01) |
| ***D03D 15/573*** | (2021.01) |
| ***D03D 15/49*** | (2021.01) |
| ***A41D 13/00*** | (2006.01) |
| ***D03D 13/00*** | (2006.01) |

(52) U.S. Cl.
CPC ..... *D03D 15/283* (2021.01); *A41D 13/0015* (2013.01); *A41D 31/04* (2019.02); *D03D 13/008* (2013.01); *D03D 15/00* (2013.01); *D03D 15/49* (2021.01); *D03D 15/573* (2021.01); *A41D 2600/10* (2013.01); *D10B 2331/04* (2013.01); *D10B 2401/063* (2013.01)

(58) Field of Classification Search
CPC .... D03D 15/283; D03D 13/008; D03D 15/00; D03D 15/49; D03D 15/573; D03D 15/567; D03D 15/43; A41D 13/0015; A41D 31/04; A41D 2600/10; D10B 2331/04; D10B 2401/063; D06M 2200/12; D06M 15/27; D06M 15/277
See application file for complete search history.

(56) References Cited

U.S. PATENT DOCUMENTS

| | | | | |
|---|---|---|---|---|
| 8,297,035 | B2 * | 10/2012 | Chikatsune | D01D 5/24 57/243 |
| 9,783,916 | B2 * | 10/2017 | Tone | D03D 15/573 |
| 10,927,482 | B2 * | 2/2021 | Tanaka | D06M 15/333 |
| 2012/0114940 | A1 * | 5/2012 | Kamada | D02G 1/20 264/103 |
| 2013/0239289 | A1 * | 9/2013 | Iwashita | A41D 1/00 2/69 |
| 2019/0055674 | A1 * | 2/2019 | Tanaka | D06M 15/333 |
| 2020/0291551 | A1 | 9/2020 | Carls et al. | |

FOREIGN PATENT DOCUMENTS

| | | | |
|---|---|---|---|
| CN | 1416484 | A | 5/2003 |
| CN | 102317518 | A | 1/2012 |
| CN | 102859056 | A | 1/2013 |
| CN | 107208327 | A | 9/2017 |
| CN | 109385726 | A | 2/2019 |
| JP | 03-241024 | A | 10/1991 |
| JP | 08-199448 | A | 8/1996 |
| JP | 10-204746 | A | 8/1998 |
| JP | 2003-193348 | A | 7/2003 |
| JP | 2003-193349 | A | 7/2003 |
| JP | 2004-316015 | A | 11/2004 |
| JP | 2006-257592 | A | 9/2006 |
| JP | 2009-127158 | A | 6/2009 |
| JP | 2009-263832 | A | 11/2009 |
| JP | 2010-156064 | A | 7/2010 |
| JP | 4541502 | B2 | 9/2010 |
| JP | 2013-226750 | A | 11/2013 |
| JP | 2014-070281 | A | 4/2014 |
| JP | 2016-089293 | A | 5/2016 |
| JP | 2020-002476 | A | 1/2020 |
| WO | 2019068476 | A1 | 4/2019 |

OTHER PUBLICATIONS

European Search Report dated Apr. 26, 2022 in Application No. 20791712.1.

(Continued)

*Primary Examiner* — Robert H Muromoto, Jr.
(74) *Attorney, Agent, or Firm* — Sughrue Mion, PLLC

(57) ABSTRACT

A task is to provide a cloth which is excellent not only in tear strength but also in snagging resistance and wear resistance, and which preferably has design properties and stretchability, and a garment obtained using the cloth, and a solution to problem is a woven fabric containing two or more types of yarns, the woven fabric comprising a high strength yarn A having a yarn strength of 4.3 cN/dtex or more and a yarn B having a yarn strength which is smaller than that of the high strength yarn A, wherein the difference in total fineness between the high strength yarn A and the yarn B is 20 dtex or less.

10 Claims, No Drawings

(56) References Cited

OTHER PUBLICATIONS

Office Action dated Aug. 15, 2022 from the China National Intellectual Property Administration in CN Application No. 202080028605.5.
Communication dated Oct. 11, 2022 from the Japanese Patent Office in JP Application No. 2021-514864.
Communication dated Oct. 25, 2022 from the Japanese Patent Office in JP Application No. 2021-514864.
International Search Report of PCT/JP2020/014977 dated Jul. 7, 2020 [PCT/ISA/210].
International Preliminary Report on Patentability with Translation of Written Opinion dated Sep. 28, 2021 in International Application No. PCT/JP2020/014977.

* cited by examiner

TEXTILE AND GARMENT

CROSS REFERENCE TO RELATED APPLICATIONS

This application is a National Stage of International Application No. PCT/JP2020/014977, filed Apr. 1, 2020, claiming priority to Japanese Patent Application No. 2019-077140, filed Apr. 15, 2019.

TECHNICAL FIELD

The present invention relates to a cloth which is excellent not only in tear strength but also in snagging resistance and wear resistance, and a garment obtained using the cloth.

BACKGROUND ART

Conventionally, in clothing used in sports, a problem frequently occurs in that the cloth tears due to rough movement of the person who wears the clothing, and therefore the cloth used in such clothing is required to have a high strength. For this reason, woven fabric having a strength increased by, for example, using a ripstop structure has been proposed (see, for example, PTLs 1 and 2).

However, the proposed woven fabric has a problem in that the ripstop portion has an uneven surface caused due to a difference in fineness, so that the fabric cannot achieve satisfactory snagging resistance and wear resistance.

CITATION LIST

Patent Literature

PTL 1: JP-A-2006-257592
PTL 2: JP-A-2016-089293

SUMMARY OF INVENTION

Technical Problem

In view of the above, the present invention has been made, and an object of the invention is to provide a cloth which is excellent not only in tear strength but also in snagging resistance and wear resistance, and which preferably has design properties and stretchability, and a garment obtained using the cloth.

Solution to Problem

The present inventors have conducted extensive and intensive studies with a view toward achieving the object. As a result, it has been found that, by improving the yarns constituting the woven fabric and the like, a cloth which is excellent not only in tear strength but also in snagging resistance and wear resistance can be obtained, and further extensive and intensive studies have been made, and thus the present invention has been completed.

Specifically, in the present invention, there is provided "a woven fabric containing two or more types of yarns, the woven fabric comprising a high strength yarn A having a yarn strength of 4.3 cN/dtex or more and a yarn B having a yarn strength which is smaller than that of the high strength yarn A, wherein the difference in total fineness between the high strength yarn A and the yarn B is 20 dtex or less".

In the woven fabric, it is preferred that each of the high strength yarn A and the yarn B has a total fineness of 56 dtex or less. Further, it is preferred that the high strength yarn A is a polyester false twisted crimped textured yarn having a matting agent content of 0.2% by weight or less, and the yarn B is a polyester false twisted crimped textured yarn having a matting agent content of more than 0.2% by weight. It is preferred that the high strength yarn A is arranged in a lattice pattern. It is preferred that the woven fabric has a cover factor CF of 1,000 or more, wherein the cover factor CF is defined by the following formula:

$$CF=(DWp/1.1)^{1/2}\times MWp+(DWf/1.1)^{1/2}\times MWf$$

wherein DWp is a total fineness (dtex) of warp yarns, MWp is the number of warp yarns per unit length (number of yarns/2.54 cm), DWf is a total fineness (dtex) of weft yarns, and MWf is the number of weft yarns per unit length (number of yarns/2.54 cm).

In the woven fabric of the invention, it is preferred that the woven fabric has a weight per unit of 100 g/m$^2$ or less. Further, it is preferred that the woven fabric has been subjected to water-repellent processing or sweat-absorption processing. It is preferred that the woven fabric has a surface roughness SMD of 3 μm or less, wherein the surface roughness SMD is measured in accordance with the KES method (frictional static load: 50.0 g; roughness static load: 10.0 g; rate of travel of a sample: 1 mm/sec; tension: 400 g). It is preferred that the woven fabric has a tear strength of 8 N or more in the warp direction or in the weft direction. It is preferred that the woven fabric has a snagging resistance of class 3 or higher, wherein the snagging resistance is measured in accordance with JIS L 1058-2011 D-1 Method.

Further, in the present invention, a garment obtained using the above-mentioned woven fabric is provided.

Advantageous Effects of Invention

By the present invention, there are obtained a cloth which is excellent in tear strength, snagging resistance, and wear resistance, and which further has design properties and stretchability, and a garment obtained using the cloth.

DESCRIPTION OF EMBODIMENTS

Hereinbelow, an embodiment of the present invention will be described in detail. The cloth of the invention comprises a high strength yarn A having a yarn strength of 4.3 cN/dtex or more (preferably 4.3 to 30.0 cN/dtex, especially preferably 4.8 to 20.0 cN/dtex) and a yarn B having a yarn strength which is smaller than that of the high strength yarn A. When the high strength yarn A is not contained in the cloth of the invention, excellent tear strength disadvantageously cannot be obtained. The high strength yarn may be produced by, for example, the method described in JP-B-5-18935 or JP-A-2013-119689. On the other hand, the yarn B can be produced by a general method. The yarn strength can be measured in accordance with JIS L 1013-2010 8.5.

Further, it is important that the difference in total fineness between the high strength yarn A and the yarn B is 20 dtex or less (preferably 10 dtex or less, more preferably 5 dtex or less, most preferably 0 dtex). When the cloth further contains an additional yarn, it is preferred that the difference in total fineness between the yarn having the largest total fineness and the yarn having the smallest total fineness among the yarns contained in the cloth is 20 dtex or less (preferably 10 dtex or less, more preferably 5 dtex or less, most preferably 0 dtex). When the difference in total fineness is more than 20 dtex, it is likely that the woven fabric has an uneven surface caused due to the fineness difference, so that the snagging resistance and wear resistance become poor.

With respect to the yarns contained in the cloth, in view of the lightweight properties, it is preferred that any of the yarns has a total fineness of 56 dtex or less. It is more preferred that all the yarns constituting the woven fabric have a total fineness of 56 dtex or less (preferably 10 to 35 dtex, more preferably 20 to 34 dtex). Further, it is preferred that all the yarns constituting the woven fabric have a single fiber fineness in the range of from 0.0001 to 5.0 dtex (more preferably 0.5 to 5.0 dtex). The total fineness can be measured in accordance with JIS L 1013-2010 8.3 A Method.

With respect to the type of the fiber constituting the yarns (the high strength yarn A, yarn B, and the like) contained in the cloth, a polyester fiber, an acrylic fiber, a nylon fiber, a rayon fiber, an acetate fiber, or a natural fiber, such as cotton, wool, or silk, or a conjugate fiber thereof can be used. Particularly, a polyester fiber or a nylon fiber is preferred.

With respect to polyester forming the polyester fiber, preferred is polyester having terephthalic acid as a main acid component, and having as a main glycol component an alkylene glycol having 2 to 6 carbon atoms, specifically, at least one member selected from the group consisting of ethylene glycol, trimethylene glycol, tetramethylene glycol, pentamethylene glycol, and hexamethylene glycol. Of these, especially preferred is polyester having ethylene glycol as a main glycol component (polyethylene terephthalate) or polyester having trimethylene glycol as a main glycol component (polytrimethylene terephthalate). The polyester may have a copolymerized component in a small amount (generally 30 mol % or less) if necessary.

The polyester may be one which is synthesized by an arbitrary method. For example, explanation is made below on polyethylene terephthalate. Polyethylene terephthalate may be one that is produced through a first stage reaction in which terephthalic acid and ethylene glycol are directly subjected to an esterification reaction, or a lower alkyl ester of terephthalic acid, such as dimethyl terephthalate, and ethylene glycol are subjected to a transesterification reaction, or terephthalic acid and ethylene oxide are reacted to form a glycol ester of terephthalic acid and/or a low polymer thereof, and a second stage reaction in which the reaction product obtained in the first stage is heated under a reduced pressure to cause a polycondensation reaction until a desired degree of polymerization is achieved. Alternatively, the polyester may be polyester obtained by material recycle or chemical recycle, or, as described in JP-A-2004-270097 and JP-A-2004-211268, polyester obtained using a catalyst containing a specific phosphorus compound and titanium compound. Further alternatively, the polyester may be polyester having biodegradability, such as polylactic acid or stereocomplex polylactic acid.

Further, if necessary, the polyester may contain one or more members of a matting agent (such as titanium oxide), a micropore forming agent (organic sulfonic acid metal salt), a color protection agent, a thermal stabilizer, aflame retardant (diantimony trioxide), a fluorescent brightener, a coloring pigment, an antistatic agent (sulfonic acid metal salt), a moisture absorbing agent (polyoxyalkylene glycol), an anti-fungus agent, and other inorganic particles.

In the above-mentioned fiber, with respect to the cross-sectional form of the single fiber, there is no particular limitation, and a known cross-sectional form, such as a circle, a triangle, a flattened shape, or a hollow form, may be employed.

The fiber may be a spun yarn, but is preferably a multifilament. The fiber is especially preferably a false twisted crimped textured yarn.

With respect to the false twisted crimped textured yarn, there are a so-called one heater false twisted crimped textured yarn which has false twist set in the first heater region, and a so-called second heater false twisted crimped textured yarn which has torque reduced by further introducing the above yarn into the second heater region to subject the yarn to relaxation heat treatment. Further, according to the direction of twisting, there are a false twisted crimped textured yarn having torque in the S direction and a false twisted crimped textured yarn having torque in the Z direction. These false twisted crimped textured yarns can be used.

It is preferred that the high strength yarn is a polyester false twisted crimped textured yarn having a matting agent content of 0.2% by weight or less (preferably 0.02 to 0.1% by weight).

A polyester crimped yarn having a high strength can be produced by, for example, the method described in JP-B-5-18935.

In the woven fabric of the invention, in view of improving the tear strength, it is preferred that the high strength yarn A is intermittently arranged in at least one of the warp direction and the weft direction of the woven fabric (preferably in the warp direction and the weft direction). Particularly, it is preferred that the high strength yarn A is arranged in the warp direction and the weft direction so as to be in a lattice pattern. In this case, it is preferred that the high strength yarn A and the yarn B are arranged in the ratio of (high strength yarn A) 1 to 3: (yarn B) 4 to 10 in the warp yarn and the weft yarn of the woven fabric.

It is preferred that the high strength yarn A is a polyester yarn (preferably a polyester false twisted crimped textured yarn) having a matting agent content of 0.2% by weight or less (such as bright polyester or super bright polyester) and, meanwhile, the yarn B is a polyester yarn (preferably a polyester false twisted crimped textured yarn) having a matting agent content of more than 0.2% by weight (such as semidull polyester or fulldull polyester), and the high strength yarn A is arranged in a lattice pattern, and, in this case, the woven fabric having not only excellent tear strength, snagging resistance, and wear resistance but also excellent design properties and stretchability is advantageously obtained.

The yarns contained in the cloth, such as the high strength yarn A and the yarn B, may be twisted at a twist multiplier of about 3,000 or less (preferably 500 to 3,000), which is represented by the following formula.

$$\text{Twist multiplier}=\text{Number of twist}[t/m]\times(\text{Total fineness}[\text{dtex}]/1.1)^{1/2}$$

The woven fabric of the invention can be produced by weaving the above-mentioned yarns using a general weaving machine. In this case, with respect to the structure of the woven fabric, there is no limitation, but preferred examples include a plain weave structure.

The obtained woven fabric may be subjected to general alkali reduction processing or dyeing finish processing by a general method. In this case, water-absorption processing by a general method, water-repellent processing, raising processing, or various types of processing for imparting a function using an ultraviolet light screening or antistatic agent, an anti-fungus agent, a deodorant, a mothproofing agent, a phosphorescent agent, a retroreflective agent, a negative ion generator, or the like may be additionally applied.

In the water-absorption processing (sweat-absorption processing), it is preferred that a hydrophilizing agent, such as PEG diacrylate or a derivative thereof, or a polyethylene terephthalate-polyethylene glycol copolymer, is deposited by the same bath processing or the like upon dyeing onto the cloth in an amount of 0.25 to 0.50% by weight, based on the weight of the cloth.

In the water-repellent processing, with respect to the type of a water repellent agent, there is no particular limitation. For example, there can be mentioned a fluorine compound, a hydrocarbon compound, and a silicone compound. If necessary, it is preferred that the surface of the woven fabric is treated using a processing agent at a pickup of about 50 to 90%, wherein the processing agent is obtained by mixing an antistatic agent, a melamine resin, and a catalyst into the water repellent agent so that the concentration of the water repellent agent becomes about 3 to 15% by weight. Examples of methods for treating the surface of the woven fabric using the processing agent include a padding method and a spraying method. Of these, in view of the penetration of the processing agent into the inside of the woven fabric, the padding method is preferred. The pickup means a ratio (%) of the weight of the processing agent to the weight of the woven fabric (before applying the processing agent).

With respect to the antistatic agent, preferred are a polyester resin containing a polyethylene glycol group, an urethane resin containing a polyethylene glycol group, a reaction product of a polycationic compound containing a polyethylene glycol group and a glycidyl ether, and the like. The antistatic agent may be an antistatic compound, e.g., an anionic surfactant, such as a higher alcohol sulfate salt, a sulfated oil, a sulfonic acid salt, or a phosphate salt; a cationic surfactant, such as an amine salt type, a quaternary ammoniumsalt, oranimidazoline type quaternarysalt; anonionic surfactant, such as a polyethylene glycol type or a polyhydric alcohol ester type; or an amphoteric surfactant, such as an imidazoline type quaternary salt, an alanine type, or a betaine type.

With respect to the obtained woven fabric, in view of obtaining excellent tear strength, it is preferred that the woven fabric has a cover factor CF of 1,000 or more (preferably 1,000 to 4,500, further preferably 1,000 to 2,800), wherein the cover factor CF is defined by the following formula:

$$CF=(DWp/1.1)^{1/2}\times MWp+(DWf/1.1)^{1/2}\times MWf$$

wherein DWp is a total fineness (dtex) of warp yarns, MWp is the number of warp yarns per unit length (number of yarns/2.54 cm), DWf is a total fineness (dtex) of weft yarns, and MWf is the number of weft yarns per unit length (number of yarns/2.54 cm).

In view of the lightweight properties, the woven fabric preferably has a weight per unit of 100 g/m$^2$ or less (more preferably 20 to 80 g/m$^2$, further preferably 30 to 60 g/m$^2$).

The woven fabric of the invention has the above-mentioned construction and therefore has a flat surface. Accordingly, the woven fabric is excellent not only in tear strength but also in snagging resistance and wear resistance.

The woven fabric preferably has a surface roughness SMD of 3 μm or less (more preferably 2.5 μm or less, especially preferably 0.1 to 2.0 μm), wherein the surface roughness SMD is measured in accordance with the KES method (frictional static load: 50.0 g; roughness static load: 10.0 g; rate of travel of a sample: 1 mm/sec; tension: 400 g).

The woven fabric preferably has a tear strength of 8 N or more (more preferably 8 to 20 N) in the warp direction or in the weft direction (preferably in the warp direction and in the weft direction), wherein the tear strength is measured in accordance with JIS L 1096-2010 8.17 D Method.

The woven fabric preferably has a snagging resistance of class 3 or higher, wherein the snagging resistance is measured in accordance with JIS L 1058-2011 D 1 Method.

The garment of the invention is obtained using the above-mentioned woven fabric. The garment includes shirts, pants, and shorts, which are worn as outerwear or underwear for various sports. These can be used for both games and training. Examples include soccer shirts, golf shirts, tennis shirts, basketball shirts, table tennis shirts, badminton shirts, running shirts, soccer pants, tennis pants, basketball pants, table tennis pants, badminton pants, running pants, golf pants, undershirts for various sports, underwear for various sports, sweaters, T-shirts, jerseys, sweatshirts, and windbreakers.

The garment uses the above-mentioned woven fabric, and therefore has excellent tear strength and further has excellent snagging resistance and wear resistance.

The woven fabric may be used in fiber products other than the garment (for example, a tent, a sleeping bag, a bag, and bedding).

EXAMPLES

Hereinbelow, the present invention will be described in more detail with reference to the following Examples and Comparative Examples, which should not be construed as limiting the scope of the invention. In the following Examples, the measurements were individually conducted by the methods described below.

(1) Yarn Strength

A tensile strength of a yarn was measured in accordance with JIS L 1013-2010 8.5.

(2) Total Fineness

A total fineness of a yarn was measured in accordance with JIS L 1013-2010 8.3 A Method.

(3) Cover Factor

A cover factor CF of a woven fabric was determined from the following formula:

$$CF=(DWp/1.1)^{1/2}\times MWp+(DWf/1.1)^{1/2}\times MWf$$

wherein DWp is a total fineness (dtex) of warp yarns, MWp is the number of warp yarns per unit length (number of yarns/2.54 cm), DWf is a total fineness (dtex) of weft yarns, and MWf is the number of weft yarns per unit length (number of yarns/2.54 cm).

(4) Tear Strength of Woven Fabric

A tear strength (N) was measured in accordance with JIS L 1096-2010 8.17 D Method.

(5) Snagging Resistance of Woven Fabric

A snagging resistance (class) was measured in accordance with JIS L 1058-2011 D-1 Method.

(6) Weight Per Unit of Woven Fabric

A weight per unit (g/m$^2$) of a woven fabric was measured in accordance with JIS L1096-2010 8.3.

(7) Water Repellency

A water repellency (class) was measured in accordance with JIS L1092-20097.2 Water repellency test (spraying method).

(8) Surface Roughness

A surface roughness SMD (μm) was measured in accordance with the KES method: frictional static load: 50.0 g; roughness static load: 10.0 g; rate of travel of a sample: 1 mm/sec; tension: 400 g; plane to be measured: surface.

Example 1

Weaving with a specification such that the number of warp yarns per unit length is 135 yarns/2.54 cm and the number of weft yarns per unit length is 130 yarns/2.54 cm was conducted by arranging, as warp yarns, a polyester crimped yarn having a total fineness of 33 dtex/36 fil and having a yarn strength of 3.0 cN/dtex (semidull; number of twist: S300 t/m; yarn B) and a polyester crimped yarn having a total fineness of 33 dtex/36 fil and having a yarn strength of 4.9 cN/dtex (bright; number of twist: S300 t/m; high strength yarn A) in this order in the 7:2 ratio, and using, as weft yarns, a polyester crimped yarn having a total fineness of 33 dtex/36 fil and having a yarn strength of 3.0 cN/dtex (semidull; number of twist: S300 t/m; yarn B) and a polyester crimped yarn having a total fineness of 33 dtex/36 fil and having a yarn strength of 4.9 cN/dtex (bright; number of twist: S300 t/m; high strength yarn A) in this order in the 5:2 ratio, obtaining a plain woven fabric.

Then, the woven fabric was subjected to general dyeing finish processing and general water-repellent processing, and then subjected to final setting.

In the obtained woven fabric, the weight per unit was 55 g/m$^2$, the number of warp yarns per unit length was 165 yarns/2.54 cm, the number of weft yarns per unit length was 155/2.54 cm, the cover factor was 1,753, the tear strength was 10.0 N or more both in the warp and weft directions, the snagging resistance was class 3, the surface roughness SMD (warp-weft average) was 1.445 μm, and the water repellency and the wear resistance were excellent. Further, the high strength yarn A (bright polyester crimped yarn) was arranged in a lattice pattern and thus the design properties and the stretchability were excellent.

Comparative Example 1

Substantially the same procedure as in Example 1 was conducted except that the polyester crimped yarn having a total fineness of 33 dtex/36 fil and having a yarn strength of 4.9 cN/dtex in Example 1 was not used, and a polyester crimped yarn having a total fineness of 33 dtex/36 fil and having a yarn strength of 3.0 cN/dtex (semidull; number of twist: S300 t/m) was arranged as a warp yarn and a weft yarn.

In the obtained woven fabric, the weight per unit was 56 g/m$^2$, the number of warp yarns per unit length was 167 yarns/2.54 cm, the number of weft yarns per unit length was 156/2.54 cm, the cover factor was 1,769, the snagging resistance was class 3, the surface roughness SMD (warp-weft average) was 1.401 μm, and the water repellency and the wear resistance were excellent, but the tear strength was as low as 6.9 N in the warp direction and 6.2 N in the weft direction.

Comparative Example 2

Substantially the same procedure as in Example 1 was conducted except that the polyester crimped yarn having a total fineness of 33 dtex/36 fil and having a yarn strength of 3.0 cN/dtex in Example 1 was not used, and a polyester crimped yarn having a total fineness of 33 dtex/36 fil and having a yarn strength of 4.9 cN/dtex (bright; number of twist: S300 t/m; high strength yarn A) was arranged as a warp yarn and a weft yarn.

In the obtained woven fabric, the weight per unit was 53 g/m$^2$, the number of warp yarns per unit length was 162 yarns/2.54 cm, the number of weft yarns per unit length was 152/2.54 cm, the cover factor was 1,720, the tear strength was 13 N both in the warp and weft directions, the snagging resistance was class 3, the surface roughness SMD (warp-weft average) was 1.469 μm, and the wear resistance was excellent, but the hand was felt hard and the gloss was high and thus the texture was poor. Further, the water repellency was poor.

Comparative Example 3

Weaving with a specification such that the number of warp yarns per unit length is 126 yarns/2.54 cm and the number of weft yarns per unit length is 121 yarns/2.54 cm was conducted by arranging, as warp yarns, a polyester crimped yarn having a total fineness of 33 dtex/36 fil and having a yarn strength of 3.0 cN/dtex (semidull; number of twist: S300 t/m) and a polyester crimped yarn having a total fineness of 66 dtex/72 fil and having a yarn strength of 3.2 cN/dtex (semidull; non-twisted) in this order in the 7:1 ratio, and using, as weft yarns, a polyester crimped yarn having a total fineness of 33 dtex/36 fil and having a yarn strength of 3.0 cN/dtex (semidull; number of twist: S300 t/m) and a polyester crimped yarn having a total fineness of 66 dtex/72 fil and having a yarn strength of 3.0 cN/dtex (semidull; non-twisted) in this order in the 5:1 ratio, obtaining a plain woven fabric. Then, the woven fabric was subjected to general dyeing finish processing and general water-repellent processing, and then subjected to final setting.

In the obtained woven fabric, the weight per unit was 55 g/m$^2$, the number of warp yarns per unit length was 154 yarns/2.54 cm, the number of weft yarns per unit length was 144/2.54 cm, the cover factor was 1,730, the tear strength was 11 N both in the warp and weft directions, the snagging resistance was class 3, and the water repellency was excellent, but the surface roughness SMD (warp-weft average) was 4.568 μm, and the fabric had an uneven surface caused due to a difference in fineness, and hence had a poor wear resistance.

INDUSTRIAL APPLICABILITY

In the present invention, there are provided a cloth which is excellent in tear strength, snagging resistance, and wear resistance, and which further has design properties and stretchability, and a garment obtained using the cloth, and the invention is of extremely great industrial significance.

The invention claimed is:

1. A woven fabric containing two or more types of yarns, the woven fabric comprising a high strength yarn A having a yarn strength of 4.3 cN/dtex or more and a yarn B having a yarn strength which is smaller than that of the high strength yarn A, wherein the difference in total fineness between the high strength yarn A and the yarn B is 10 dtex or less, and the high strength yarn A and yarn B are constituted of a polyester fiber, and the woven fabric has a tear strength measured in accordance with JIS L 1096-2010 8.17 D Method of 8 N or more in the warp direction or in the weft direction, and the woven fabric has a snagging resistance of class 3 or higher, wherein the snagging resistance is measured in accordance with JIS L 1058-2011 D-1 Method.

2. The woven fabric according to claim 1, wherein each of the high strength yarn A and the yarn B has a total fineness of 56 dtex or less.

3. The woven fabric according to claim 1, wherein the high strength yarn A is a polyester false twisted crimped textured yarn having a matting agent content of 0.2% by weight or less, and the yarn B is a polyester false twisted crimped textured yarn having a matting agent content of more than 0.2% by weight.

4. The woven fabric according to claim 1, wherein the high strength yarn A is arranged in a lattice pattern.

5. The woven fabric according to claim 1, which has a cover factor CF of 1,000 or more, wherein the cover factor CF is defined by the following formula:

$$CF=(DWp/1.1)^{1/2}\times MWp+(DWf/1.1)^{1/2}\times MWf$$

wherein DWp is a total fineness (dtex) of warp yarns, MWp is the number of warp yarns per unit length (number of yarns/2.54 cm), DWf is a total fineness (dtex) of weft yarns, and MWf is the number of weft yarns per unit length (number of yarns/2.54 cm).

6. The woven fabric according to claim 1, which has a weight per unit of 100 $g/m^2$ or less.

7. The woven fabric according to claim 1, which has been subjected to water-repellent processing or sweat-absorption processing.

8. The woven fabric according to claim 1, which has a surface roughness SMD of 3 μm or less, wherein the surface roughness SMD is measured in accordance with the KES method (frictional static load: 50.0 g; roughness static load: 10.0 g; rate of travel of a sample: 1 mm/sec; tension: 400 g).

9. A garment which is obtained using the woven fabric according to claim 1.

10. The woven fabric according to claim 2, wherein the high strength yarn A is a polyester false twisted crimped textured yarn having a matting agent content of 0.2% by weight or less, and the yarn B is a polyester false twisted crimped textured yarn having a matting agent content of more than 0.2% by weight.

* * * * *